US007380306B2

(12) United States Patent
Broman

(10) Patent No.: US 7,380,306 B2
(45) Date of Patent: Jun. 3, 2008

(54) MOP ASSEMBLY AND MOP COMPRISING SUCH A MOP ASSEMBLY

(75) Inventor: Daniel Broman, Stockholm (SE)

(73) Assignee: Smart Products Scandinavia AB, Hagerstan (SE)

( * ) Notice: Subject to any disclaimer, the term of this patent is extended or adjusted under 35 U.S.C. 154(b) by 491 days.

(21) Appl. No.: 10/535,229

(22) PCT Filed: Apr. 29, 2004

(86) PCT No.: PCT/SE2004/000661

§ 371 (c)(1),
(2), (4) Date: May 17, 2005

(87) PCT Pub. No.: WO2004/096003

PCT Pub. Date: Nov. 11, 2004

(65) Prior Publication Data

US 2006/0075587 A1 Apr. 13, 2006

(30) Foreign Application Priority Data

May 2, 2003 (SE) ..... 0301292

(51) Int. Cl.
*A47L 13/12* (2006.01)

(52) U.S. Cl. ..... 15/118; 15/115; 15/117; 15/121

(58) Field of Classification Search ..... 15/115, 15/117, 118, 121, 228, 231
See application file for complete search history.

(56) References Cited

U.S. PATENT DOCUMENTS

| | | | | |
|---|---|---|---|---|
| 3,737,938 | A * | 6/1973 | Saltzstein | 15/231 |
| 3,783,467 | A | 1/1974 | Grossman | |
| 5,416,945 | A | 5/1995 | Price | |
| 5,937,471 | A | 8/1999 | Liao | |
| 2003/0074756 | A1 * | 4/2003 | Policicchio et al. | 15/228 |

FOREIGN PATENT DOCUMENTS

| | | | |
|---|---|---|---|
| DE | 7637585 | U | 5/1977 |
| FR | 2783696 | A1 | 3/2000 |
| JP | 200234883 | A | 2/2002 |
| SE | 302189 | B | 7/1968 |

* cited by examiner

*Primary Examiner*—Mark Spisich
(74) *Attorney, Agent, or Firm*—Myers Bigel Sibley & Sajovec, P.A.

(57) ABSTRACT

A mop assembly for a mop includes an under side having a first fastener for holding a cleaning cloth, and an upper side parallel with the under side. The upper side is provided with a holder for holding a shaft. At least one side surface interconnects the under side with the upper side. The side surface includes second and third fasteners, which are provided opposite of each other on opposite sides of the under and upper sides in order to hold a liquid scraper and a stain scraper such that the mop assembly can handle three difference cleaning functions.

10 Claims, 1 Drawing Sheet

MOP ASSEMBLY AND MOP COMPRISING SUCH A MOP ASSEMBLY

RELATED APPLICATIONS

The present application is a 35 U.S.C. §371 National Phase application of International Application Serial No. PCT/SE2004/000661, filed on Apr. 29, 2004 and published in English as PCT Publication No. WO 2004-096003, which claims priority from Swedish Patent Application No. 030 1292-9, filed on May 2, 2003, the disclosures of which are incorporated herein by reference in their entireties.

FIELD OF THE INVENTION

The present invention generally relates to the field of cleaning devices and more particularly to a mop and a mop assembly for cleaning of among other things floors.

BACKGROUND OF THE INVENTION

It is commonly known to use mops in order to for instance scrub floors. It is also previously known to combine a mop with one other function. For instance U.S. Pat. No. 5,416,945 describes a floor mop with a sponge on its under side as well as a scrubber strip provided on a side surface of the mop in order to scrub away stains.

US-2002/0162573 describes yet another floor mop that has a sponge on its under side and a scrub- or scraping device on the short side of the mop. The mop furthermore comprises means for twisting the mop shaft, among other things from an upright position and a lying position in the direction away from the scraping device in order to provide better usage of the scraping device.

U.S. Pat. No. 5,937,471 describes a multipurpose mop that has a head where a mopping cloth can be held. The head can furthermore be folded and a inserting unit can be placed therein. The inserting unit combines a brush with a water scraper, where the bristles face downwards from the bottom side of the folded head and the water scraper is provided approximately 90 degrees displaced from the brush. Mopping seems hard to perform when the inserting unit is fastened to the mop.

FR-2 783 696 describes a device with a head that on its under side comprises threads for cleaning of different surfaces. In one embodiment of this device a brush is provided on one side and a stain scraper is provided on another opposite side of the mop. This device provides, apart from the function of mopping floors, also the function of removing stains. The stain removal can here either take place with the aid of the brush or with the aid of the scraper. The device also comprises a shaft on the upper side. However, this shaft can not be turned.

All these documents describe combinations of two different functions in relation to a mop. It would however be advantageous if it were possible to combine more functions in one and the same mop.

SUMMARY OF THE INVENTION

The present invention thus relates to the provision of three different cleaning functions in one and the same mop.

This is achieved by a mop assembly for a mop for cleaning of among other things floors and comprising:

an under side having first fastener for holding a cleaning cloth, an upper side, parallel with the under side, provided with a holder for holding a shaft, and at least one side surface that interconnects the under side with the upper side, wherein said side surface comprises second and third fasteners, which are provided opposite of each other on opposite sides of the under and upper sides, in order to hold a liquid scraper and a stain scraper such that the mop assembly can handle three different cleaning functions.

The object is also achieved by a mop comprising such a mop assembly.

The dependent claims are directed towards advantageous embodiments of the invention.

Because of the invention a mop and a mop assembly are obtained that simultaneously offer three different functions. Further advantages of the invention will become apparent by the following detailed description of a preferred embodiment of the invention.

BRIEF DESCRIPTION OF THE DRAWINGS

The present invention will now be described in more detail with reference being made to the accompanying drawings, where.

DETAILED DESCRIPTION OF EMBODIMENTS OF THE INVENTION

Figure 1:
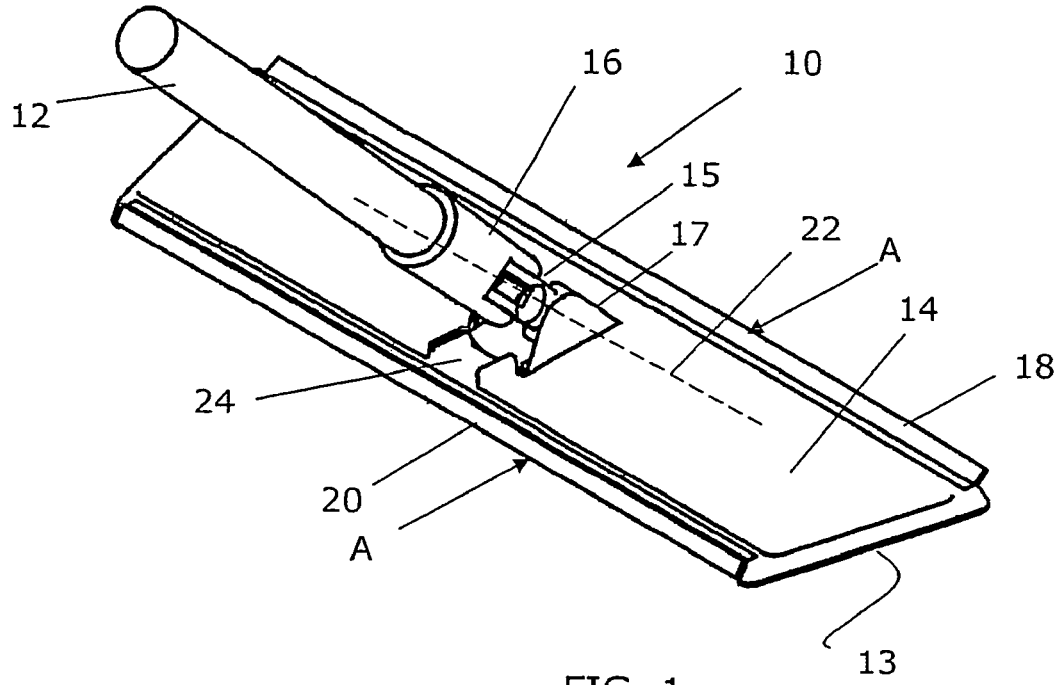
FIG. 1 shows a perspective view of the mop according to the invention.

FIG. 1 shows a perspective view of a floor cleaning mop comprising a mop assembly 10 and a shaft 12. The assembly 10 has an upper side 14 having a trapezium shape as well as an under side 13 also having a trapezium shape. The under and upper sides therefore each have two opposite parallel long sides of unequal length as well as two short sides of equal length but not parallel with each other. The upper and under sides are furthermore parallel with each other, i.e. they are provided in parallel planes. At the under side 13 of the mop assembly 10 there are provided first fasteners in order to fasten a cleaning cloth, which is preferably a micro fibre cloth. On one side surface (not shown) at one long side of the upper side, which here is the longest long side, a liquid scraper 18 is fastened. On one side surface (not shown) of the other long side of the upper side 14 a stain scraper 20 is fastened. A holder is provided in the middle of the upper side 14 in order to hold a shaft 12. The holder comprises three parts. A bottom part 17 is solidly joined with and projects out from the upper side 14 and is joined with an intermediate part 15. Through this connection a first axis 22 that is essentially parallel with the upper side and that is essentially perpendicular to both the long sides is defined. The axis is preferably provided through pins provided in the intermediate part 15 that project into matching openings in the bottom part. The axis can also be provided in other ways, like for instance through a bolt. This first axis enables turning of the shaft around the first axis. In this way it is possible to turn the shaft by approximately 180 degrees from long side to long side. The intermediate part 15 is in turn joined to a top part 16 of the holder, which has a cavity in which an end of the shaft can be inserted and removed. In the upper side 14 there is furthermore provided a support 24 in proximity of the shorter long side in order to stop the shaft and the rotating parts of the holder 15 and 16 from being moved sideways when the shaft has been turned around the first axis such that it essentially abuts on the stain scraper 20. The support 24 is adapted in shape to the top part 16 of the holder and is therefore formed as a groove, in which this top part can be put down.

Figure 2:
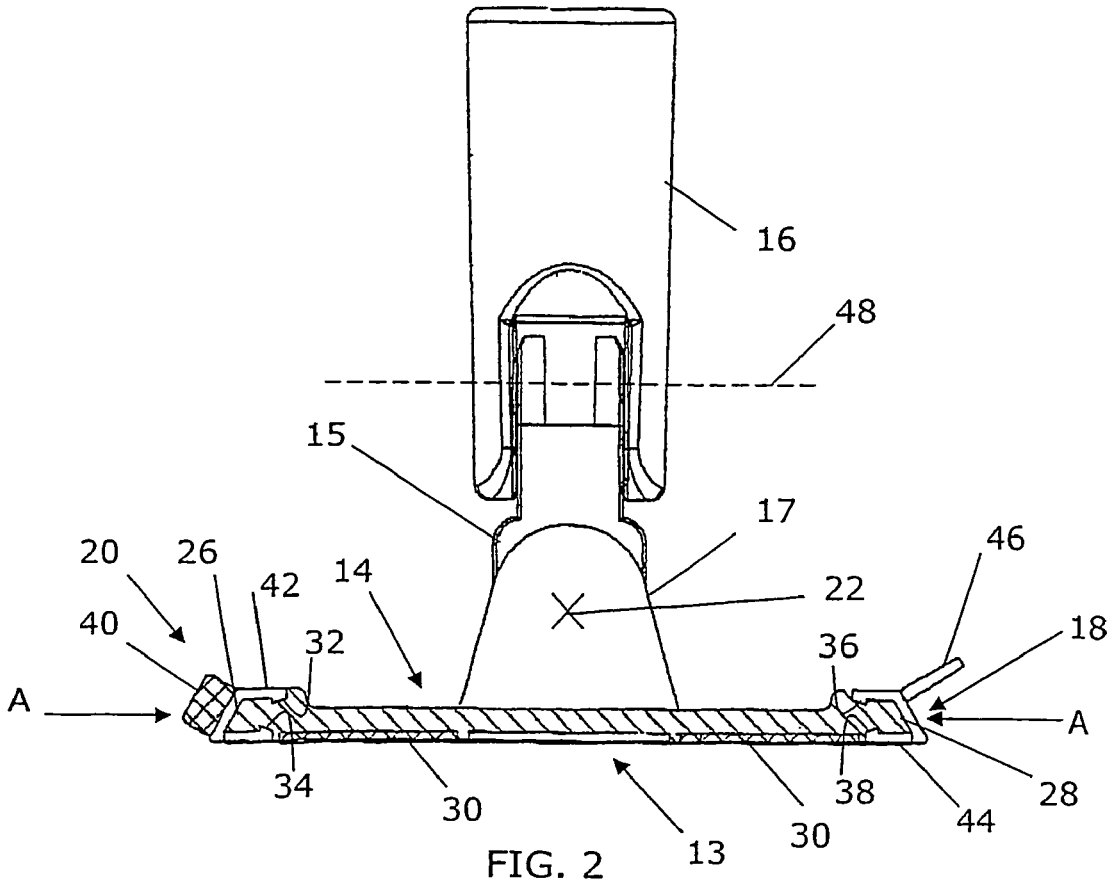
FIG. 2 shows a cross-sectional view through the mop assembly according to the invention.

FIG. 2 shows a cross-sectional view taken along line A-A in FIG. 1. However the support is omitted in this figure. From FIG. 2 it can be seen that the intermediate part 15 of the holder is turnably joined to the top part 16 such that a second axis 48 is defined, around which the top part can be made to turn in relation to the intermediate part. This second axis is obtained through pins in the top part 16 that project into corresponding cavities in the intermediate part 15. This axis 48 is perpendicular to the first axis 22 and enables turning of the shaft from short side to short side. The combination of the first and second axis enables a turning of the shaft with 360 degrees around a third axis (not shown) that is defined through the bottom part 17 of the holder at right angles out from the upper side 14. This combination enables simpler use of the mop for cleaning of for example floors. The under side 13 of the assembly here comprises first fasteners 30 in the form of two strips of Velcro on which the cleaning cloth can be fastened. This guarantees that the cloth is easily held in place and can be substituted if it is so desired. In the figure two side surfaces 26 and 28 can also be seen, where a first 28 interconnects the longer side of the upper and under sides and on which the liquid scraper 18 is provided and a second 26 interconnects the shorter long side of the under and upper sides where a stain scraper 20 is fastened. These side surfaces are angled towards the upper side 14. Both scrapers are removably held by the assembly. This is achieved through the upper side having a first 36 and second 32 groove and the under side having a third 38 and fourth 34 groove placed some ways in from the corresponding short side. The first 36 and third 38 grooves here make up a second fastener for the liquid scraper and the second 32 and fourth 34 groove make up a third fastener for the stain scraper. The liquid scraper 18 here has a part 44 which is adapted in shape to the first side surface 28, the grooves 36 and 38 as well as to the areas of the upper and under sides that extend between the grooves and the first side surface 28. The part that is adapted in shape therefore includes two longitudinal strips that in their longitudinal direction essentially stretch along the first side surface and in their breadth stretch over the under and upper sides 14 and 13, respectively. On the inner side of the strips longitudinal projections are provided that mate with the grooves 36 and 38. The scraper 18 then stretches at right angles out from the first side surface 28. Also the stain scraper 20 has a part 42 than is in the same manner adapted in shape to the opposite side of the assembly. The liquid scraper 18 and the stain scraper 20 are thereby angled towards the upper side 14 of the assembly. The stain scraper 20 also comprises a strip 40 of non-woven material that preferably comprises an abrasive agent. Though these parts that are adapted in shape easy removal of both the scrapers for replacement for instance because of wear, is enabled.

The liquid scraper 18 is preferably provided through so called co-extruding of two thermoplastic materials, where the scraper 46 itself is of an EPDM related material (ethylene-propylene-terpolymer rubber) and preferably of SEBS (Polystyrene-ethylene-butadiene-styrene) with a hardness of between 40-70 Shore and preferably 60 Shore. The parts 42 and 44 that are adapted in shape are preferably of polypropylene PP that in the case of the liquid scraper thus have been co-extruded with SEBS. This choice of material enables the part of the scraper that is adapted in shape to be stiff enough to be fastened to the assembly while it is flexible enough to enable removal of the scraper. The stain scraping part 40 is here glued to the part 42 that is adapted in shape, preferably through melting. As is mentioned above the stain scraping part is preferably of a non-woven material and then includes fibres of polyamide and polyester with vinylacrylic and ureic resin and also comprises an abrasive agent, for instance a mineral. It should however be realised that it can be provided without mineral. As an alternative it is possible to consider providing this stain scraper through co-extruding of polypropylene and a thermoplastic such as SEBS, where this thermoplastic is filled with mineral in order to provide the scraping function. The stain scraper can also be provided in the form of a strip, which can be equipped with an abrasive agent inside, possibly melted inside, or on its surface. The mop assembly and the bottom part of the holder are preferably made of polystyrene PS and the intermediate part of the holder and the upper part of PA6 (polyamide 6). Through the construction of the mop and the mop assembly shown in FIGS. 1 and 2 it is easy to perform three different cleaning functions without having to change any items. The mop can easily be used for mopping floors with or without water. By guiding the holder downwards into the support that is provided on the upper side of the assembly at the same time as the upper side with the liquid scraper is turned towards the surface to be cleaned, for instance a floor, it is possible to use the mop for scraping away liquid such as water from wet areas. The angling of the first side surface towards the upper side will then give the liquid scraper a good angle against the surface to be scraped that provides an ergonomically beneficial working position for the user. It should here be realised that the scraper need not be used on floors, but can be used on walls, such as for instance on tiled walls, or even against windows. A turning of the shaft by about 180 degrees around the first axis in relation to the position for liquid scraping then enables the stain scraper to be used in a similar fashion for stain removal from for instance floors. When the shaft is made to abut on the upper side of the mop assembly an ergonomically beneficial working position is obtained because of the angling of the second side surface.

Because all three items, cleaning cloth, liquid scraper and stain scraper easily can be separately removed from the mop assembly, a device is obtained where the different items can easily be replaced, all in dependence of when they wear out. It is also possible to envision that because of this it is also possible to replace one or several of the items for another type that provides another function or variations of the same function.

The invention can be varied in a multitude of ways. For instance the upper and under sides of the mop assembly may have quadratic or even round shape instead. When the shape is round, there is then only one side surface that will hold both the scrapers. The side surfaces that hold the scrapers need not be angled even though this is preferred. However it is preferential if the scrapers are angled towards the upper side. The way that the scrapers and the cleaning cloth have been described as being fastened to the mop assembly should also be seen as preferred ways. These can be varied in all ways fathomable within the art. In one variation of the invention one or more of these items (i.e. scrapers and cleaning cloth) are fixedly attached to the assembly and cannot be replaced. The cleaning cloth can also possibly be replaced by another type of cloth, for instance one of cotton, with a sponge or with a variation that is provided with long threads instead.

Therefore the present invention is only to be limited by the following claims.

The invention claimed is:

1. A mop assembly for a mop, the mop assembly comprising:

an under side having a first fastener for holding a cleaning cloth;

an upper side, parallel with the under side, provided with a holder for holding a shaft; and at least one side surface that interconnects the under side with the upper side;

wherein said side surface comprises second and third fasteners, which are provided opposite of each other on opposite sides of the under and upper sides in order to hold a liquid scraper and a stain scraper such that the mop assembly can handle three different cleaning functions;

wherein the under and upper sides each include four straight sides, where at least a first and a second opposite side are essentially parallel and the second and third fasteners are provided on first and second side surfaces that border on said first and second sides of the under and upper side;

wherein the fasteners are provided to separately and removably hold the cleaning cloth, the liquid scraper and the stain scraper to the assembly; and wherein the second and third fasteners are provided through grooves provided in the upper and under sides in proximity of the first and second side surfaces such that two edge areas are formed that each comprise a groove in the upper and under side, respectively, at least parts of the side surface in proximity of these grooves as well as areas of the upper and under sides that extend between the side surface and the grooves, wherein each scraper is adapted in shape to a corresponding edge area.

2. The mop assembly of claim 1 wherein the holder defines at least one axis round which the shaft can turn with approximately 180 degrees, which axis is parallel with the upper side and essentially perpendicular to the second and third fastener.

3. The mop assembly of claim 1 wherein the first and second side surfaces are provided between two opposite long sides of the upper and under sides.

4. The mop assembly of claim 1 wherein the first and second side surfaces are angled towards the upper side.

5. The mop assembly of claim 1 wherein the liquid scraper and the stain scraper are angled towards the upper side when being held by the fasteners.

6. The mop assembly of claim 1 wherein the liquid scraper comprises a flexible thermoplastic.

7. The mop assembly of claim 1 wherein the stain scraper comprises a non-woven material.

8. The mop assembly of claim 1 wherein the stain scraper comprises a strip including a melted abrasive agent inside.

9. The mop assembly of claim 1 wherein the cleaning cloth is a micro fiber cloth.

10. A mop comprising:

a mop assembly comprising:

an under side having a first fastener for holding a cleaning cloth;

an upper side, parallel with the under side, provided with a holder for holding a shaft; and at least one side surface that interconnects the under side with the upper side;

wherein a liquid scraper and a stain scraper are fastened to said side surface opposite to each other on opposite sides of the under and upper side by second and third fasteners such that the mop assembly can handle three different cleaning functions;

wherein the under and upper sides each include four straight sides, where at least a first and a second opposite side are essentially parallel and the second and third fasteners are provided on first and second side surfaces that border on said first and second sides of the under and upper side;

wherein the fasteners are provided to separately and removably hold the cleaning cloth, the liquid scraper and the stain scraper to the assembly; and wherein the second and third fasteners are provided through grooves provided in the upper and under sides in proximity of the first and second side surfaces such that two edge areas are formed that each comprise a groove in the upper and under side, respectively, at least parts of the side surface in proximity of these grooves as well as areas of the upper and under sides that extend between the side surface and the grooves, wherein each scraper is adapted in shape to a corresponding edge area.

* * * * *

UNITED STATES PATENT AND TRADEMARK OFFICE

CERTIFICATE OF CORRECTION

PATENT NO. : 7,380,306 B2
APPLICATION NO. : 10/535229
DATED : June 3, 2008
INVENTOR(S) : Broman It is certified that error appears in the above-identified patent and that said Letters Patent is hereby corrected as shown below:

On Title Page:

Item 73: Please correct "Hagerstan (SE)"
To read -- Hagersten (SE) --

Item 57: Abstract line 9 – 10, Please correct "difference cleaning functions."
To read -- different cleaning functions --

Signed and Sealed this

Fifth Day of August, 2008

JON W. DUDAS
*Director of the United States Patent and Trademark Office*